US008079827B2

(12) United States Patent
Iwa et al.

(10) Patent No.: US 8,079,827 B2
(45) Date of Patent: Dec. 20, 2011

(54) DISPLACEMENT CONTROL VALVE

(75) Inventors: Toshiaki Iwa, Tokyo (JP); Ryosuke Cho, Tokyo (JP); Ichiro Hirata, Tokyo (JP); Matthew R. Warren, Buffalo, NY (US); Ernest Jose Gutierrez, Amherst, NY (US)

(73) Assignee: Eagle Industry Co., Ltd., Tokyo (JP)

( * ) Notice: Subject to any disclaimer, the term of this patent is extended or adjusted under 35 U.S.C. 154(b) by 621 days.

(21) Appl. No.: 12/282,879

(22) PCT Filed: Mar. 15, 2007

(86) PCT No.: PCT/JP2007/055280

§ 371 (c)(1),
(2), (4) Date: Dec. 29, 2008

(87) PCT Pub. No.: WO2007/119380

PCT Pub. Date: Oct. 25, 2007

(65) Prior Publication Data

US 2009/0183786 A1 Jul. 23, 2009

(30) Foreign Application Priority Data

Mar. 15, 2006 (JP) ..... 2006-071274

(51) Int. Cl.
*F04B 1/26* (2006.01)

(52) U.S. Cl. ..... 417/222.2; 417/272; 137/3

(58) Field of Classification Search ..... 417/222.2, 417/272; 137/625.65
See application file for complete search history.

(56) References Cited

U.S. PATENT DOCUMENTS

| | | | | |
|---|---|---|---|---|
| 6,371,734 | B1 | 4/2002 | Ota et al. | |
| 2003/0145615 | A1 * | 8/2003 | Sasaki et al. | 62/228.3 |
| 2007/0145315 | A1 * | 6/2007 | Uemura et al. | 251/84 |
| 2009/0114871 | A1 * | 5/2009 | Iwa | 251/318 |
| 2009/0246041 | A1 * | 10/2009 | Taguchi | 417/307 |

FOREIGN PATENT DOCUMENTS

| | | |
|---|---|---|
| JP | 2001-153044 | 6/2001 |
| JP | 2003-254246 | 9/2003 |
| JP | 2003-322086 | 11/2003 |

* cited by examiner

*Primary Examiner* — Toan Ton
*Assistant Examiner* — Kevin Quarterman
(74) *Attorney, Agent, or Firm* — Squire Sanders & Dempsey (US) LLP

(57) ABSTRACT

A displacement control valve for an air conditioner modulating a fluid flow or fluid pressure within a control chamber by controlling the opening degree of a valve portion.

2 Claims, 6 Drawing Sheets

DISPLACEMENT CONTROL VALVE

TECHNICAL FIELD

This invention relates to a displacement control valve for modulating an air conditioner. More particularly, the invention relates to a displacement control valve with which the control chamber is able to modulate a compressor in an air conditioner regardless of outside temperature.

BACKGROUND ART

As a related art of the present invention, there is a constitution that a displacement control valve is attached to a variable displacement compressor (for example, refer to Patent Document 1 described in a following column 0011). A constitution which is similar with the variable displacement compressor is shown in FIG. 6. FIG. 6 is whole cross sectional views showing a displacement control valve connected with a variable displacement compressor. A displacement control valve 100 is equipped within a mounting portion which is not shown in the displacement control type compressor 100. However, in order to clarify the displacement control valve 100, the valve is shown as taken out from the variable displacement compressor 150.

The variable displacement compressor 150 of FIG. 6 will be specified briefly. In FIG. 6, the variable displacement compressor 150 is formed by a casing to form an outer shape composed of a cylinder block 151 to which a plurality of cylinder bore 151A is provided, a front housing 152 provided at an end of the cylinder block 151, a rear housing 153 connected to the cylinder block 151 via a valve plate device. A crank chamber (control chamber) 155 defined by the cylinder block 151 and the front housing 152 is provided to the casing. A transverse shaft 156 is provided in the crank chamber. A skewed plate having a disc shape is arranged at a peripheral of a center portion of the shaft 156. The skewed plate is composed so as to have an angle incline the skewed plate 157 to the shaft 156 by connecting a long hole of a connecting portion 159 and a pin of a rotor 158 fixed to the shaft 156. Note that a side face of the rotor 158 is supported by a bearing 176.

One end of the shaft extends to an outer portion with penetrating in a boss portion 152A which projects to an outside of the front housing 152. A seal portion 152B is provided at an inner circumference of the boss portion 152A. The crank chamber 155 is sealed internally by the seal portion 152B.

A bearing 175 is arranged between the shaft 156 and the boss portion 152A. Further, a bearing 177 is provided at another end of the shaft 156. And the bearings 175, 177 support the shaft 156 rotatably.

Respective pistons 162 are provided in a plurality of cylinder bores 151A provided on a circumference in the cylinder block 151. Further, a recess portion 162A is provided at an inner side of one end of the piston 162. Then, outer circumference of the skewed plate 157 is connected slidably via a shoe 163 arranged in the recess portion 162A of the piston 162. Also, it is constituted that the skewed plate 157 and a connecting portion 159 are rotatably connected each other via a link mechanism.

In the rear housing 153, a discharge chamber 164 and an air inlet chamber 165 are formed and partitioned. The air inlet chamber 165 and an inside of the cylinder bore 151A communicate with via a suction valve provided on a valve plate device 154. Also, the discharge chamber 164 and the inside of the cylinder bore 151A communicated with via a discharge valve provided on the valve plate device 154.

Next, with respect to a displacement control valve 100 equipped to the variable displacement compressor 150 will be specified briefly. The displacement control valve 100 is composed on a solenoid portion 140 and a valve portion 115. A suction chamber 165 of the variable displacement compressor 150 communicates with a suction valve chamber 126 via a suction fluid passage 110 for an inlet pressure Ps. Also, the discharge chamber 164 communicates with a discharge valve chamber 106 via a discharge fluid passage for a discharge pressure PD. Further, the crank chamber 155 communicates with a control valve chamber 104 via a control fluid passage 109 for a control pressure Pc. Then, a valve portion 121 acts by a cooperating action by a movable iron core 142 integrally with a rod 120 which operates in response to an amount of current flows in a electromagnetic coil 145 of the solenoid portion 140, and a force acts on a pressure sensing device 122 provided in the control chamber 104 of the valve unit 115. The valve unit 115 controls a fluid of the control pressure Pc by open and close between a control valve chamber 104 and a discharge valve chamber 106 according to an action of the valve portion 121. In a constitution of the existing displacement control valve 100, the control valve chamber 104 does not communicate with the suction valve chamber 126 even as the valve portion 121 opens and closes the valve.

In the variable displacement compressor (clutch less compressor) 150 to which the displacement control valve 100 is provided, the skewed plate 157 co-rotates by rotation of the rotor 158. Also, an angle of inclination of the skewed plate 157 changes in response to the control pressure PC in the crank chamber 155. Further, the piston 162 moves as reciprocate motion, in response to the change of the angle of inclination of the skewed plate 157. A refrigerant discharged from the discharge chamber 164 according to the reciprocating motion of the piston 162 is provided to an evaporation chamber G from an expansion valve via a condensing chamber P. In this process, the variable displacement compressor 150 returns the refrigerant to the suction chamber 165 with cooling the vehicle interior. Note that, the control pressure Pc of the crank chamber 155 is determined by a flow amount flew from the discharge chamber 164 to the crank chamber 15 in response to a valve opening degree of the displacement control valve and a discharge amount discharged through a fixed orifice 170 provided on the variable displacement compressor 150. There are times when liquid refrigerant exists in the crankcase and it is desirable to increase the cross-sectional area of the fixed orifice 170 so that the liquid refrigerant vaporizes rapidly. However, normal pressure control in the crank chamber 155 becomes problematic and this cross-sectional area cannot be enlarged.

Then, in a region where there are warm and cold on day and night, after the variable displacement compressor 150 stops, then, when it becomes night and temperature decreases, the refrigerant gas is liquefied and pools in the crank chamber 155 of the variable displacement compressor 150. This variable displacement compressor 150 can only be operated at minimum capacity when it is started until crank chamber pressure decreases to a pressure close to suction chamber pressure, which takes a relatively long time since the crank chamber 155 communicates with the suction chamber 165 only via the fixed orifice 170. The crank chamber pressure is greater than the suction chamber pressure because the liquid in the crank chamber 155 is evaporating faster than the vapor can exit to the suction chamber 165 through the fixed orifice 170. The crank chamber pressure does not decrease until all the liquid refrigerant is evaporated and discharged. Thus, without increasing the refrigerant flow rate out of the crank chamber 155, the compressor does not operate at a normal capacity for an extended time up to 5 minutes and passenger comfort is poor for several minutes more. There is a problem. The orifice needs to be small to be able to control crank chamber pressure and it also needs to be large to permit the compressor to start and operate at normal capacity after less than a minute. Then, upon solving this problem, in order to minimize the product cost of the variable displacement compressor 150, it is required to improve a function of the displacement control valve 100 from the market.

[Patent Document 1] Japanese Patent Laid Open No. 2003-322086 (FIG. 6 and the like)

DISCLOSURE OF INVENTION

Problem to be Solved by the Invention

The present invention was made upon considering the above mentioned problem. The technical problem to be solved by the invention is to allow the compressor to reach normal capacity rapidly with a novel displacement control valve under alternating warm and cold environmental conditions such that liquid pools in the compressor crank chamber. Also, it is in order to reduce a manufacturing cost of the displacement control valve in the compressor. Further, it is in order to reduce a size of a compressor by downsizing a displacement control valve equipped thereto.

Means for Solving Problem

The present invention was achieved to solve the above mentioned technical problems, and its technical solutions are constituted as follows.

A displacement control valve according to the present invention is that a displacement control valve modulating a fluid flow or fluid pressure within control chamber by means of controlling the opening degree of valve portion, said displacement control valve comprises;

a valve main body having a first valve chamber, a second valve chamber and a third valve chamber, said first valve chamber communicates with a first communication passage for permitting fluid at control pressure to flow therethrough, said second valve chamber having a second valve seat face for a valve hole communicating with said first valve chamber, said second valve chamber communicating with a second communication passage for permitting fluid at discharge pressure to flow therethrough, said third valve chamber having a third valve seat face, said third valve chamber communication with a third communication chamber for permitting fluid at suction pressure to flow therethrough;

a valve body being disposed within said valve main body and having a first valve member, a second valve member and a third valve member, said second valve member having an intermediate communication passage therein communicating with said first valve chamber and said third communication passage, said second valve member opening or closing a valve hole with respect to said second valve seat face, thereby communicating with said first valve chamber and said second valve chamber, said third valve member performing a valve opening/closing action with respect to said third valve seat face in an reverse synchronous manner against said valve member, thereby opening or closing the communication with said intermediate communication passage and said third communication passage, said first valve member being disposed in said first valve chamber and performing a valve opening/closing action in the same direction in a synchronous manner to said second valve member;

a pressure sensing member being disposed within said first valve chamber, said pressure sensing member having a valve seat portion, said valve seat portion being disposed at a free end of said pressure sensing member, said free end performing an expanding or contracting action in accordance with suction pressure, said valve seat portion performing a valve opening/closing action with respect to said first valve member, thereby opening or closing the communication with said first valve chamber and said intermediate communication passage; and a solenoid member being installed in said valve main body, said solenoid member driving said valve body for opening or closing the respective valves of said valve body in accordance with an electric current supplied thereto;

wherein an auxiliary communication passage is disposed in said valve body and/or said valve seat portion within said first valve chamber, said auxiliary communication passage providing a communication between said first valve chamber and said intermediate communication passage.

EFFECT OF THE INVENTION

In a displacement control valve according to the present invention, when the ambient temperature drops during night its refrigerant liquid remains within the control chamber which is located inside the refrigerant compressor. The displacement control valve of the present invention, however, has an advantage of being capable of vaporizing refrigerant liquid in the control chamber and starting cooling operation ten to fifteen times faster than conventional displacement control valves do, because the control chamber is designed to be communicatable, via auxiliary communication passage and intermediate communication passage, with the third communication passage under influence of suction pressure. This quick start-up of cooling operation is made possible with no need of design alternation to the control chamber related to the displacement control valve or air conditioner. The displacement control valve therefore not only is outstanding in cooling control performance but also has an advantage of reducing manufacture cost for air conditioner as well as displacement control valve.

Further, a minimum displacement in compressor can be achieved during cooling operation of the air conditioner. Closing action of the third valve member prevents the fluid in control chamber under the influence of control pressure from reaching the third communication passage. Opening action of the second valve member then permits a transition to discharge pressure state, which enables the displacement control valve to maintain the pressure in the control chamber above a preset value and stop the compressor from cooling the passenger compartment. It also has an advantage of minimizing the operation cost of the air conditioner.

| Explanations of letters or numerals | |
|---|---|
| 1 | Displacement control valve |
| 2 | Valve main body |
| 2A | First valve main body |
| 2B | Second valve main body |
| 3 | Separation adjustment portion |
| 4 | First valve chamber (capacity chamber) |
| 5 | Valve hole |
| 6 | Second valve chamber |
| 6A | Second valve seat face |
| 7 | Third valve chamber |
| 7A | Guiding surface |
| 8 | Second communication passage |
| 9 | First communication passage |
| 10 | Third communication passage |
| 11 | Auxiliary communication passage |
| 15 | Valve portion |
| 17 | Coil spring (resilient urging means) |
| 21 | Valve body |
| 21A | First valve member |
| 21A1 | First valve face |
| 21B | Second valve member |
| 21B1 | Second valve face |
| 21C | Third valve member |
| 21H | Sliding face |
| 22 | Pressure sensing member (pressure sensing device) |
| 22A | Bellows |
| 22B | Valve seat portion |
| 22C | First valve seat face |
| 25 | Solenoid rod |
| 25A | Joint portion |
| 26 | Intermediate communication passage |
| 28 | Releasing spring means (first releasing spring means) |
| 40 | Solenoid portion |
| 41 | Fixed iron core |
| 42 | Plunger |
| 42A | Mating bore |
| 42B | Contact face |
| 43 | Solenoid case |
| 43A | Empty chamber |
| 44 | Plunger casing |
| 45 | Electromagnetic coil |
| 46 | O-ring |
| 51 | Fixed iron core |
| 51A | Inner diameter surface |
| 51A1 | Passage |
| 51B | Receiving face |
| 51C | Spring seating chamber |
| 51D | Third valve seat face |
| 55 | Crank chamber (control chamber) |
| 64 | Discharge chamber |
| 65 | Suction chamber |
| Ps | Suction pressure |
| Pd | Discharge pressure |
| Pc | Control pressure |
| Ab | Effective pressure receiving area of pressure sensing device |
| As | Seal pressure receiving area of second valve member |
| Ar2 | Pressure receiving area of third valve member |
| S1 | Spring force of spring (resilient urging) means |
| Fb | Spring (resilient urging) force of pressure sensing device |

BEST MODE FOR CARRYING OUT THE INVENTION

Figure 1:
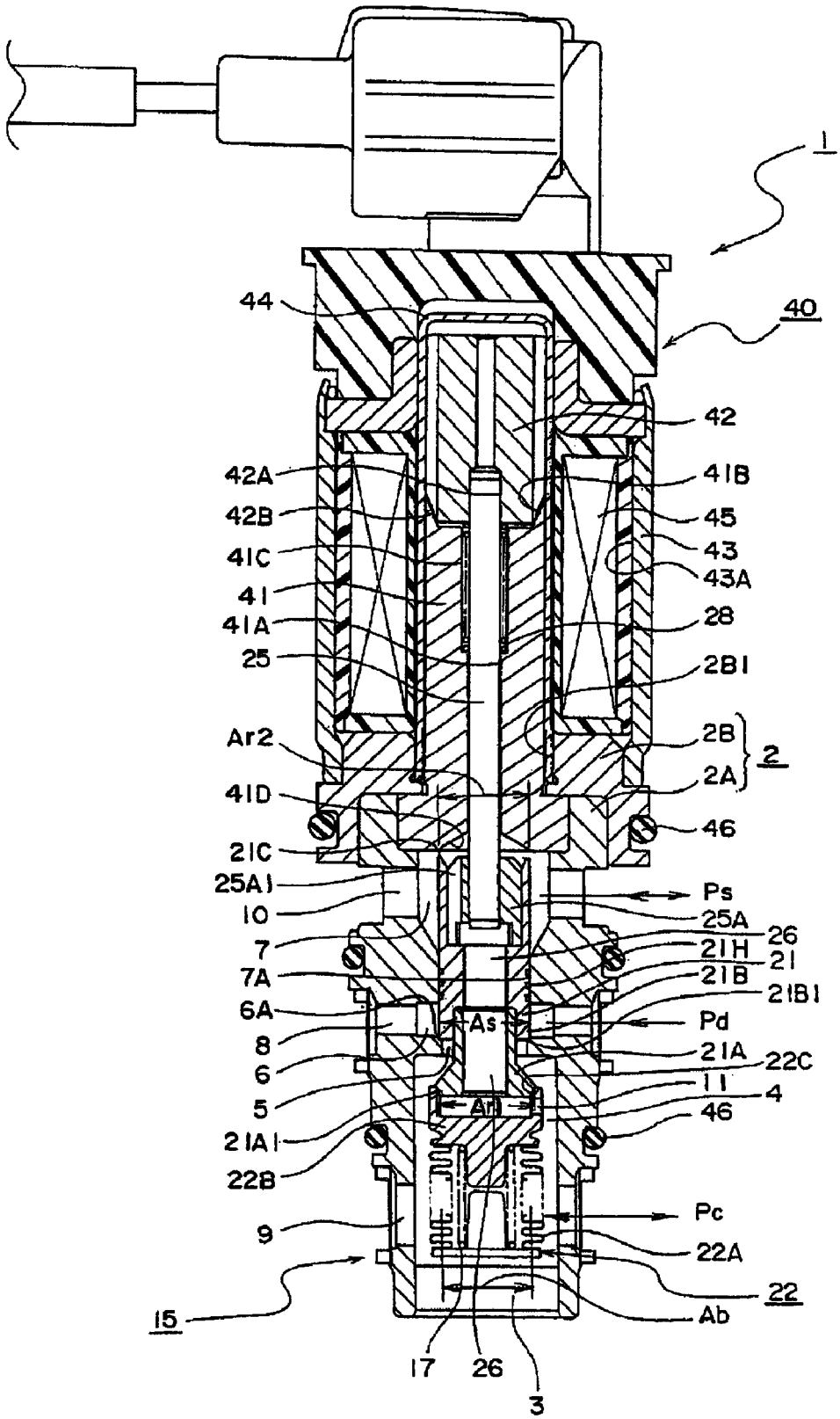
FIG. 1 shows a full cross-sectional view of a displacement control valve as a first embodiment of the present invention.

A displacement control valve of a preferred embodiment according to the present invention will be described based on referring drawings. Note that, following respective drawings are accurate drawings of design basis FIG. 1 shows a full cross-sectional view of a displacement control valve according to the present invention. In FIG. 1, 1 is a displacement control valve. A valve main body 2 to form outer shape is provided on the displacement control valve 1. The valve main body 2 is composed of a first valve main body 2A to form a through hole, a function is given therein, and a second valve main body 2B which is integrally fitted to one end portion of the first valve main body 2A. The first valve main body 2A is manufactured by metal such as brass, iron, aluminum, stainless and the like or synthetic resin member and the like. Also, the second valve main body is formed by magnetic substance such as iron and the like.

Also, since the second valve main body 2B must be for connecting a solenoid portion 40 and must be a magnetic substance, it is provided separately from a material and function of the first valve main body 2A. A form shown in FIG. 1 may suitably be modified, upon considering this point. Also, in the first valve main body 2A, a separation adjustment portion 3 is connected to another end of the through hole. Although this separation adjustment portion 3 slides over so as to block a first valve chamber 4 (herein after, referred to capacity chamber), when it is made as a screw type and is fixed by a screw not shown, it becomes possible to adjust movably pressure force of a pressure spring arranged in a bellows 22A in parallel or spring force of the bellows 22A to an axle direction.

A compartment of the through hole which through the axial direction of the first valve main body 2A is formed as one end thereof is in the capacity chamber 4. Further, a valve hole 5, which communicates with the capacity chamber, having its diameter smaller than that of the capacity chamber 4 is connected with the through hole. Further, also, a second valve chamber 6, which communicates with the valve hole 5, having its diameter larger than that of the valve hole 5 is connected with a compartment of the through hole. Furthermore, a third valve chamber 7, which communicates with the second valve chamber 6, is connected with the compartment of the through hole. Then, a second valve seat face is formed around the valve hole 5 at the second valve chamber 6. Although this second valve seat face 6A is formed as a tapered face towards the valve hole 5, a sealing property can be increased. This is because, when a second valve face 21B1 of a second valve member 21B is connected with the tapered face of the second valve seat face 6A, it is contacted with a small contact width.

A second communication passage 8 is formed on the second valve chamber 6 of the valve main body 2. This second communication passage 8 is constituted so as to flow a flow amount of the discharge pressure Pd to a discharge chamber 64 by the displacement control valve 1 in accordance with communicating with the discharge chamber 64 of a variable displacement compressor 50 which is one kind of air conditioner shown in FIG. 3. Further, a third communication passage 10 is formed on a third valve chamber 7 of the valve main body 2. The Third communication passage 10 is constituted so as to make possible to flow a fluid of a suction pressure Ps into a suction chamber 65 with communicating through a suction chamber 65 of the variable displacement compressor 50 of FIG. 3 as well as to make outflow by the displacement control valve 1. Also, a guiding surface 7A at the second valve chamber 6 side with respect to a third valve chamber 7 of the through hole slidingly guides a sliding face 21H of a valve body 21 towards an axial direction. A labyrinth seal may be constituted on the sliding face 21H by providing a plurality of grooves. Also, sliding resistance may be reduced by adhering fluoroethylene resin film to the guiding face 7A.

Further, a first communication passage 9 is formed on the capacity chamber 4 so as to outflow the fluid of a discharge pressure Pd from the second valve chamber 6 to a control chamber (crank chamber) 55 of the variable displacement compressor 50 Note that, the first communication passage 9, the second communication passage 8 and the third communication passage 10 penetrate on a circumference of the valve main body 2, respectively, for example at two equal intervals to six equal intervals. Further, an outer circumference face of the valve main body 2 is formed as four stage faces, mounting grooves for O-rings are provided at three positions along the axle direction. Then, O-ring 46 to seal between the valve main body 2 and a mounting hole of a casing to which the valve main body is fitted (not shown in FIG. 3) is provided into the respective mounting grooves.

Next, a pressure sensing member (herein after referred as a pressure sensing device) 22 is provided on the capacity chamber 4. This pressure sensing device 22 causes to sealingly connect one end portion of a metal made bellows 22A to a separation adjustment portion 3 as well as to connect another end to a valve seat portion 22. This bellows 22A is constructed by phosphor bronze and the like, and is designed as its spring constant is set at a predetermined value. Also, a coil spring 17 is internally installed in the bellows 22A. Note that it may be designed to install the coil spring 17 externally so as to cooperate with a spring force of the bellows 22A. The pressure sensing device 22 is designed so as to act expanding or contracting in accordance with a relative relation of a spring force of the coil spring 17 and the suction pressure Ps in the capacity chamber 17. An internal space of the pressure sensing device 22 is a vacuum or air exists therein. Then, it is constituted that a pressure in the capacity chamber 4 (for example, the pressure Pc) and the suction pressure Ps act to an effective pressure receiving area Ab of the pressure sensing device 22 so as to cause contracting action for the pressure sensing device 22.

At a free end of the pressure sensing device 22, it is provided a valve seat portion 22B having disc shape and a first valve seat face 22C is provided at an end portion circumference face. An auxiliary communication passage 11, which penetrates from a side face of the valve seat portion 22B to an intermediate communication passage 26, is formed. A diameter of the auxiliary communication passage is set in a range from 0.5 mm to 2.5 mm. Preferably, the diameter of the auxiliary communication passage is set in a range of from 0.8 to 2.0 mm. In an air conditioner for motor vehicle and the like, it is noted as a result of experiment, in case that the diameter of the auxiliary communication passage is set in the above described rage, refrigerant liquid can be evaporated rapidly even if the refrigerant liquid pools in the control chamber 55 of a skewed plate type variable displacement compressor 50 in FIG. 3.

Figure 3:
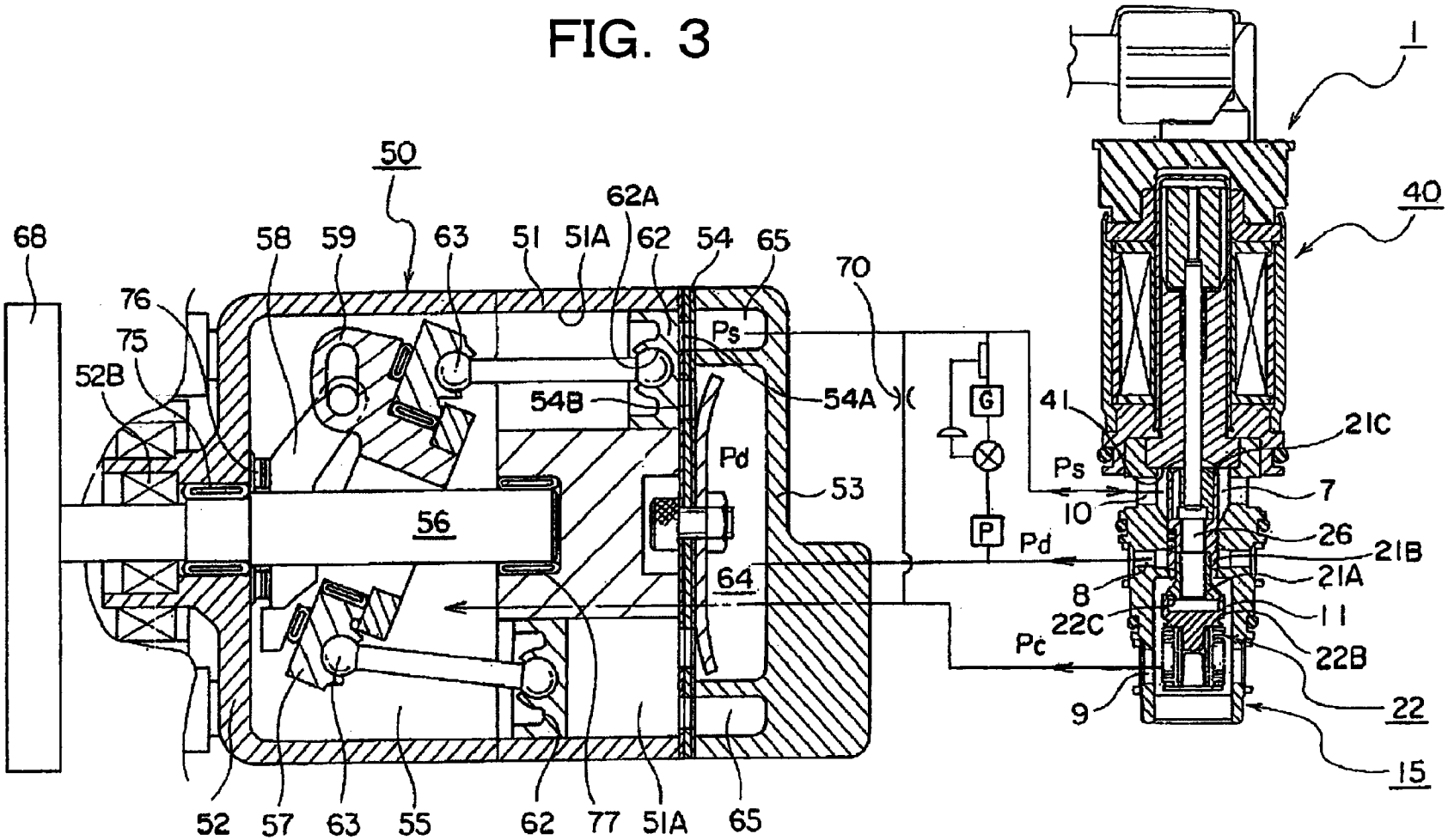
FIG. 3 shows a full cross-sectional view of the displacement control valve connected to a variable displacement compressor.

Also, by a size of a capacity of an air conditioner, it is noted that the diameter of the auxiliary communication passage 11 is changed. Note that, in a valve opening status of the first valve portion 21A by contracting the pressure sensing device 22 in response to a control pressure Pc of an evaporated refrigerant fluid, it takes more than ten minute to evaporate the refrigerant liquid. During the period, since a pressure of the control chamber 55 shown in FIG. 3 is an evaporating status, the evaporation will be further delayed since the pressure increases gradually. However, the refrigerant liquid in the control chamber 55 can be evaporated rapidly. And if the refrigerant liquid in the capacity chamber 55 evaporates at all, it becomes possible to control the pressure in the capacity chamber 55 freely by the displacement control valve. Also, if the refrigerant liquid is evaporated by other method (for example, in case that a diameter of an orifice 70 shown in FIG. 3 at a middle of the third communication passage is enlarged), manufacturing cost will be increased and the displacement control will be difficult when controlling minimum capacity of the variable displacement compressor 50.

On the other hand, a first valve member 21A performing opening/closing with a first valve seat face 22C of the valve seat portion 22B is provided at one end of the valve body 21. A first valve face 21A1 performing opening/closing with the first valve face 22C is provided on the first valve member 21A. An effective pressure receiving area of the first seat face 21A1 and the first valve seat face 22C is Ar1. Further, the first valve seat face 21 and an opposite side thereof slidingly connect integrally with a mounting hole of the second valve member 21B as a connecting portion. Then, an intermediate communication passage 26 which penetrates towards the axial direction is formed in the first valve member 21A. Although the first valve member 21A is connected to the valve body 21, both parts are divided so that they may be assembled through the valve hold 5 of the valve main body 2, it may be formed integrally in response to necessity. An outer diameter of the connecting portion of the first valve member 21A is formed as a smaller diameter than that of the valve hole 5 and as a communication passage in through the valve hole 5 so as to flow the fluid of the discharge pressure Pd between the valve hole 5 and the connecting portion at the opening time of the second valve member 21B.

The second valve member 21B at a middle portion of the valve body 21 is arranged in the valve chamber 6. Then, the valve seat face 21B1 contact with the second valve seat face 6A is provided to the second valve member 21B. A sealing area contact with the second valve seat face 6A of the second valve face is an effective pressure receiving area As. Although a contact face of the second valve seat face 6A and the second valve face 21B1 may be a planar junction, if the second valve seat face 6A is formed as tapered face, it is noted to make better contact condition as well as a sealing property when closing valve each other. When this time, the outer diameter of the second valve member 21B becomes an effective pressure receiving area As. The sealing pressure receiving area As of the second valve face 21B1 constitutes an identical area or an about identical are of the effective pressure receiving area Ab of the pressure sensing device 22.

An illustrated third valve member 21C at an upper end of the valve body 21 is arranged in the third valve chamber 7. The third valve member 21C performs opening/closing action with a third valve sheet face 51D formed on a tapered face of one end face of a fixed core iron 51. Also, an area where the fluid acts to the third valve member 21C of the valve body 21 is pressure receiving area Ar2. Note that, the sealing pressure receiving area As of the second valve face 21B, the pressure receiving area Ar2 of the third valve member 21C and the effective pressure receiving area Ab of the pressure sensing device 22 are constituted as an identical area or an about identical area. Also, in this one embodiment, it is not necessary to make an identical the pressure receiving area Ar2 of the third valve member 21C, to which the suction pressure Ps acts, with the effective pressure receiving area Ab of the pressure sensing device 22.

At an inner portion of the valve body 21, an intermediate communication passage 26 penetrates from the first valve chamber 4 to the third valve chamber 7. And when the third valve member 21C opens from the third valve seat face 51D, a control pressure Pc can outflow from the first valve chamber 4 to the third communication passage 10. The valve body 21 forms a two stage through hole at an inside. Then, a joint portion 25A provided at an end portion of a solenoid rod 25 is slidingly contacted to an outer diameter through hole (fitting hole) of the through hole of the valve body 21. Passage 25A1 formed by three equal passage spaced at equal intervals is provided at the outer circumference of the joint portion 25A.

The intermediate communication passage 26 is formed by the passage 25A1 and a through hole having small diameter (a through hole at a lower portion of a through hole having larger diameter). The third valve chamber 7 is formed as slightly larger diameter face with respect to an outer shape of the valve body 21 so as to easily flow the fluid of the suction pressure Ps from the third communication passage 10 to the third valve chamber 7. A lower portion constitution of FIG. 1 including the above mentioned valve main body 2, the valve body 21 and the pressure sensing device 22 is a valve portion 15.

Next, another end portion opposite to the joint portion 25A of the solenoid rod 25 slidingly contacts with a mating bore 42A of a plunger 42. A fixed iron core 41 which is fixed to the first valve main body 2A is provided between the valve body 21 and the plunger 42. And the solenoid rod 25 is movably fitted with an internal diameter surface 41A of the fixed iron core 41.

A spring seating chamber 51C is formed at the plunger side of the fixed iron core 41. A resilient spring means (herein after referred as a resilient urging means also) 28 is arranged in the spring seating chamber 51C to perform the first valve member 21A and the second valve member 21*b* from valve closing condition to valve opening condition. Namely, the resilient spring means 28 urges the plunger 42 away from the fixed iron core 41. An adjacency of a receiving face 41B of the fixed iron core 41 and a contact face 42 of the plunger 42 is made by the intensity of the current flowing in an electromagnetic coil 45. Also, a solenoid casing 43 is fixed at a gap portion at one end of the second valve body 2B and the electromagnetic coil is arranged in an empty chamber 43A. The solenoid portion 40 shows whole constitution of the above, and the electromagnetic coil 45 provided at the solenoid portion 40 is controlled by a controlling computer which is not shown.

A plunger casing 44 is slidingly connected with the fixed iron core 41, and the casing slidingly contacts with the plunger 42. One end of the plunger casing 44 is slidingly connected to the mating hole 2B1 of the second valve body 2B and another end is fixed to a sliding contact hole of an end portion of a solenoid casing 43. The above mentioned constitution is the solenoid portion 40.

In the displacement control valve 1 such as constructed above, a relative formula of respective spring forces generating resilient force arranged and counterbalance force generated by an active fluid pressure flown is, considering based on the construction shown in FIG. 1, $Pc(Ab-Ar1)+Pc(Ar1-As)+Pd(As-Ar2)+Ps(Ar2-Ar1)+Ps\times Ar1=Fb+S1-Fsol$. To correlate this relational expression, it becomes $Pc(Ab-As)+Pd(As-Ar2)+Ps\times Ar2=Fb+S1-Fsol$.

Then, when a relation of the effective pressure receiving area Ab of the pressure sensing device 22 and the sealing pressure receiving area As of the second valve face 21B1 and each pressure receiving area is as $Ab=As=A2$, the above formula is $Ps\times Ar2=Fb+S1-Fsol$.

Namely, when setting the effective pressure receiving area Ab, the sealing pressure receiving area As of the second valve seat face 21B1 and the pressure receiving area Ar2 of the third valve member 21C are an identical or an about identical, the displacement control valve 1 will have increased control accuracy since the only pressure acting on the valve body 21 is suction pressure which flows from the third communication passage 10.

Note that, referral numerals of the above mentioned formula are as follows;

| | |
|---|---|
| Ab | Effective pressure receiving are of pressure sensing device 22 |
| Ar1 | Pressure receiving are of first valve member 21A (cross sectional area) |
| As | Sealing pressure receiving area of second valve member 21B |
| Ar2 | Pressure receiving area of third valve member |
| Fb | Resilient urging (spring) force of pressure sensing device (whole body) |
| S1 | Spring (resilient urging) means 28 |
| Fsol | Electromagnetic force of electromagnetic coil |
| Ps | Suction pressure |
| Pd | Discharge pressure |
| Pc | Control pressure (crank camber pressure) |

Figure 2:
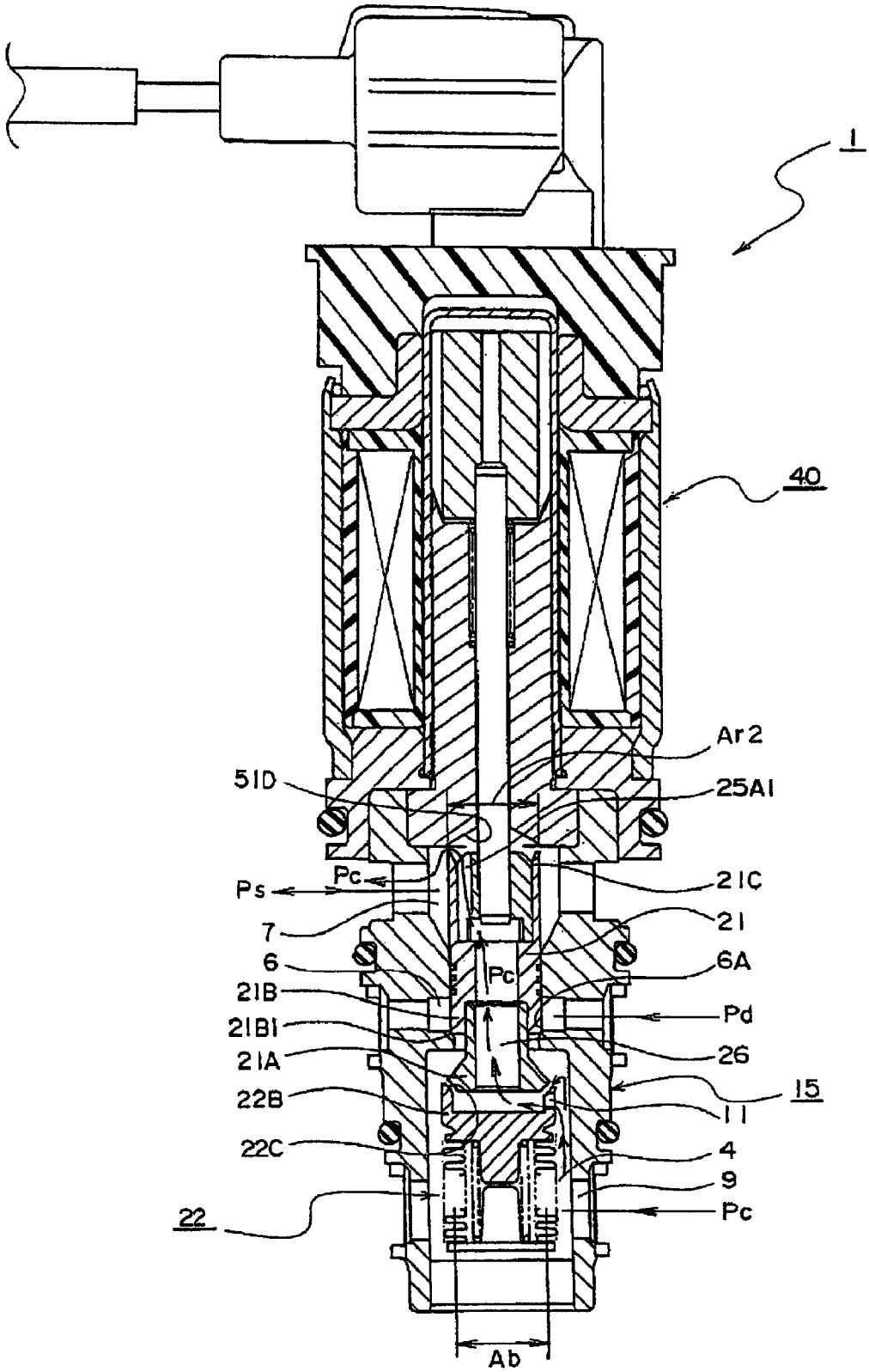
FIG. 2 shows a full cross-sectional view of the displacement control valve given in FIG. 1 in another operational step.

FIG. 1 shows a status that electric current flows in the solenoid portion 40. On the other hand, when the current does not flow in the solenoid portion 40, the third valve member 21C becomes valve closing status by the resilient spring means 28. At this time, the second valve member 21B becomes valve opening status. Also, the first valve member 21A is opened by receiving the suction pressure Ps and the control pressure Pc. FIG. 2 shows valve opening status of the displacement control valve 1 so as to evaporate rapidly the liquid refrigerant pooled in the control chamber 55 of the skewed plate type variable displacement compressor 50. Note that it is constituted that the first valve 21A and the first valve seat face 22C cannot open widely based on their normal functional purpose. Then, the refrigerant liquid in the control chamber 55 evaporates and fluid of the control pressure Pc flows from the first communication passage 9 to the first valve chamber 4. In this condition, the control pressure Pc and the suction pressure Ps is high and the pressure sensing device 22 contracts and opens a significant gap between the first valve member 21A and the first valve seat face 22C.

However, in this valve opening condition, the refrigerant liquid in the control chamber 55 accelerates very little only. Contrary this, in case that an auxiliary communication passage 11 is provided at an intermediate communication passage 26, it is noted that the refrigerant liquid in the control chamber 55 evaporates within one minute in an experiment (one experiment, an about 50 sec.). Namely, it becomes available to evaporate at a speed from ten to fifteen times faster. And when the refrigerant liquid evaporating in the control chamber 55 is finished, a pressure in the first valve chamber 4 is decreased since the control pressure Pc in the control chamber 55 is decreased. In case that the pressure in the first valve chamber 4 is decreased, the first valve member 21A and the first valve seat face 22C close valve due to the pressure sensing device 22 expands. Note that, as the second valve member 21 opens valve, the third valve member 1C closes valve, they perform opening action alternately each other, even the auxiliary communication passage is provided, the fluid of the discharge pressure Pd do not escape from the auxiliary communication passage 11 to the third communication passage 10.

Next, the displacement control valve 1 of the present invention may be used to an air conditioner using an air pump, a compressor and the like. Below, it will be specified using a skewed plate type variable displacement compressor as one embodiment.

FIG. 3 shows a full cross-sectional view of the displacement control valve 1 connected to the skewed plate type variable displacement compressor 50. Since the displacement control valve 1 is an identical constitution of FIG. 1, the constitution of the displacement control valve 1 is as mentioned above. Note that, actually, although the displacement control valve 1 is assembled in the skewed plate type variable displacement compressor 50, for easily explanation, it will be shown as taken off.

In FIG. 3, in the variable displacement compressor 50, a casing to form an outer shape is composed by a cylinder block 51 to which a plurality of cylinder bore 51A are provided on an inner circumference, a front housing 52 provided at one end of the cylinder block 51, a rear housing 53 connected with the cylinder block 51 via a valve plate device 54. A crank chamber 55 is provided and defined in the cylinder block. A traversed shaft 56 is provided in the crank case 55. A skewed plate 57 having disc shape is arranged at a circumference of a center portion of the shaft 56. The skewed plate 57 connects with the shaft 56 via a rotor 58 fixed to the shaft 56 and a connecting portion 59 and is constituted so as to make variable an angle inclined to the shaft 56. Note that, a side face of the rotor 58 is supported by a bearing 76.

One end of the shaft 56 penetrates an inner portion of a boss projected to outer side of the front housing 52 and extends until outer portion. A seal portion 52B is provided at an inner circumference of the boss. An inner portion of the crank chamber (so called as control chamber) 55 is sealed by the seal portion 52B. A bearing 75 is arranged between the shaft 56 and the boss 52A, further, a bearing 77 is arranged at another end of the shaft 56. And the bearings 75 and 77 support the shaft 56 rotatably. Also, since a pulley 68 for a V-belt is equipped at an illustrated left side of the shaft 56, the shaft 56 is rotated by a motor via the V-belt.

Each piston 62 is provided in a plurality of the cylinder bore 61A. Further, a recess portion 62A is provided at one end of the piston 62. And a spherical portion of one end of a connecting rod 63 is connected within the recess portion 62A provided on the piston 62, a spherical portion of another end of the connecting rod 63 is connected within a recess portion of the skewed plate 57. Also, the skewed plate 57 and a connecting portion 59 are rotatably connected commonly via a thrust bearing. Also, the rotor 58 and the connecting portion 59 constitute a linkage mechanism and are constituted to cooperate with other.

A discharge chamber 64 and a suction chamber 65 are formed as divided in the rear hosing 53. The suction chamber 65 and the cylinder bore 51A are communicating through via a suction valve 54A provided on the valve plate device 54. Also, the discharge chamber 64 and the cylinder bore 51A are communicating through via the discharge valve 54B provided on the valve plate 54. The suction chamber 65 communicates with the crank chamber 55 and the first communication passage 9 via a communication passage to which a fixed orifice 70 is provided.

In the constitution of the skewed plate type variable displacement compressor 50 provided with the displacement control valve 1, since the skewed plate 57 rotates commonly by a rotation of a rotor 58, the piston 62 performs reciprocate action in response to change of inclination angle of the skewed plate 57. It is constituted that refrigerant, which is discharged from the discharge chamber 64 in accordance with the reciprocating action of the piston 62, is supplied to an evaporation chamber G and is returned to the suction chamber 65 with operating cooling performance according to its determination. Note that, the fixed orifice 70 is provided in a middle of the crank chamber 55 and the suction chamber 65, however, a diaphragm aperture of a passage of the orifice 70 is enlarged for accelerating evaporation of the refrigerant liquid, a flow amount becomes larger, control of a normal displacement control valve 1 will be inaccurate. Therefore, the diaphragm aperture of the passage of the fixed orifice 70 cannot be enlarged.

Next, one example of operating the displacement control valve 1 connected with the above mentioned skewed plate type variable displacement compressor 60 will be specified. Both FIG. 1 and FIG. 3 will be referred to in the following explanation. During cold night time and the like, when stopping the skewed plate type variable displacement compressor 50, when the ambient temperature drops, the refrigerant liquefies in the crank chamber 55 of the skewed plate type displacement compressor 50. Next, the skewed plate type displacement compressor 50 is started by energizing control valve 1, but the liquid refrigerant barely evaporates. Also, the first valve member 21A and the first valve seat face 22C are not constituted to open widely upon their functions. However, when the auxiliary communication passage 11 which communicates through from the first valve chamber 4 to the intermediate communication passage 26, the control pressure PC gas which is evaporated of the refrigerant liquid in the crank chamber 55 flows to the third valve chamber 7 which is the suction pressure Ps status of low pressure through the auxiliary communication passage 11 and the intermediate communication passage 26. At this time, since the third valve member 21C opens, it can flow to the third communication passage 10 passing through between the third valve member 21C and the third valve seat face 41D. In this experiment, the refrigerant liquid in the crank chamber 55 evaporated at all at about fifty sec. to sixty sec. Note that, when the second valve member 21B opens, since the third valve member 21C is closing, it is possible to control the skewed plate 57 of the crank chamber 55 without the fluid of the discharge pressure Pd flowing to the third communication passage 10.

Figure 4:
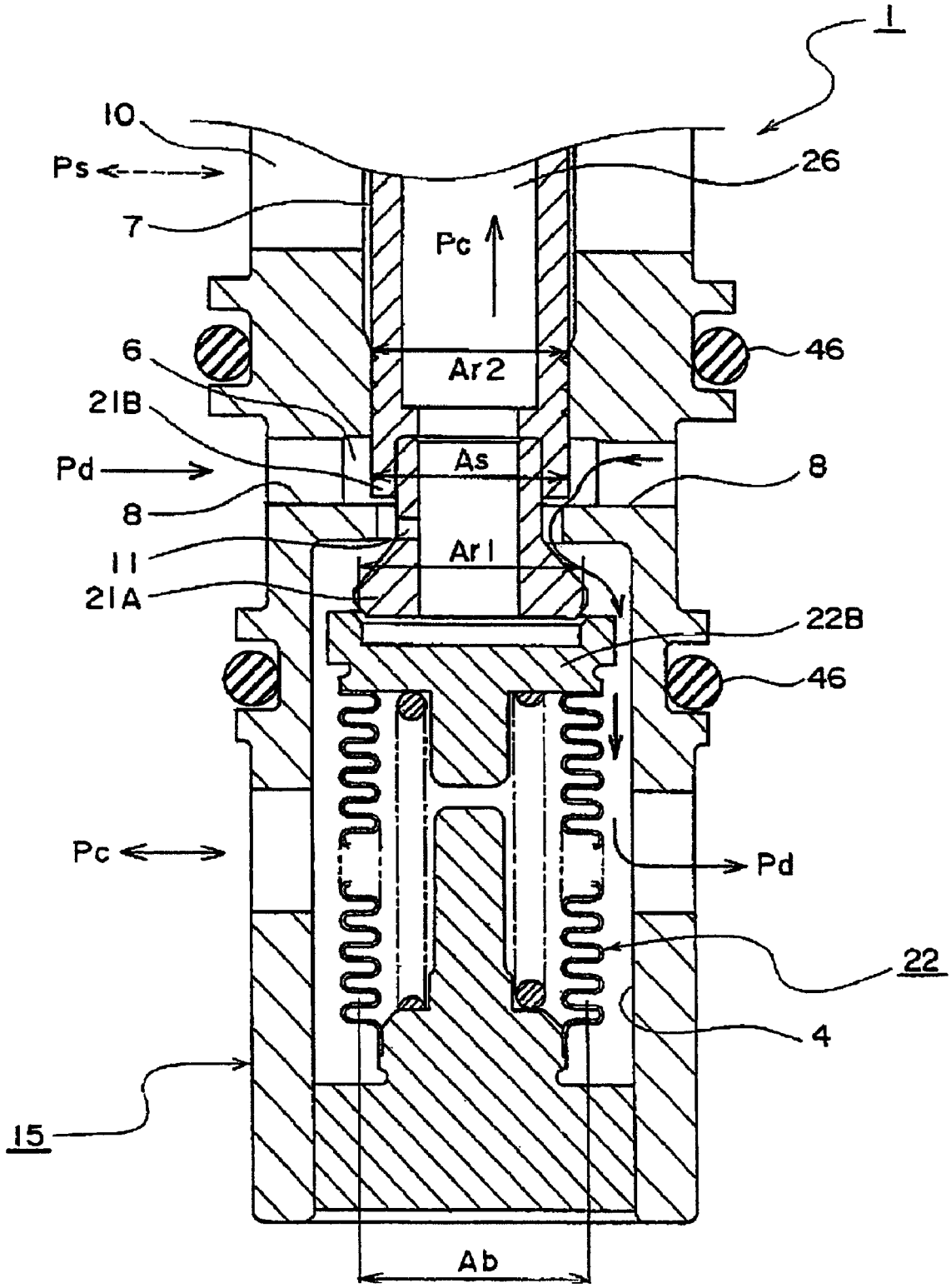
FIG. 4 shows a cross-sectional view of displacement control valve as a second embodiment of the present invention.

FIG. 4 is a partial cross-sectional view of the displacement control valve 1 showing the first embodiment. In the displacement control valve 1 of FIG. 4, a different point from the displacement control valve 1 of FIG. 1 is that the auxiliary communication passage 11 penetrates from a side face of the first valve member 21A to the intermediate communication passage 26. The auxiliary communication passage 11 may be provided on the valve seating portion 22B, further, it may be provided on the first valve member 21A. Also, it may be provided on both the valve seat portion 22B and the first valve member 21A. Namely, if the auxiliary communication passage 11 has a constitutions that enables communication from the first valve chamber 4 to the intermediate communication passage 26, then it may be provided at anywhere. Also, a third communication passage 10 side of the intermediate communication passage 26 may be a communication passage formed by the shape of the solenoid rod 25 (this communication passage, for example, may be formed as a shape having an L-shape cross section from a lower end portion of the solenoid rod 25 of FIG. 1 that penetrates into the third valve member 21C). In this case, since the solenoid rod 25 is connected to the valve body 21 directly, the joint portion 25A is not necessary. Other referral numeral components are the same as FIG. 1. Note that, FIG. 4 shows the second valve member 21B opens and allows the discharge pressure PD flow into crank chamber as well as a status that the third valve portion 21C (refer to FIG. 3) closes and blocks the discharge pressure PD flow to the third communication passage 10.

Figure 5:
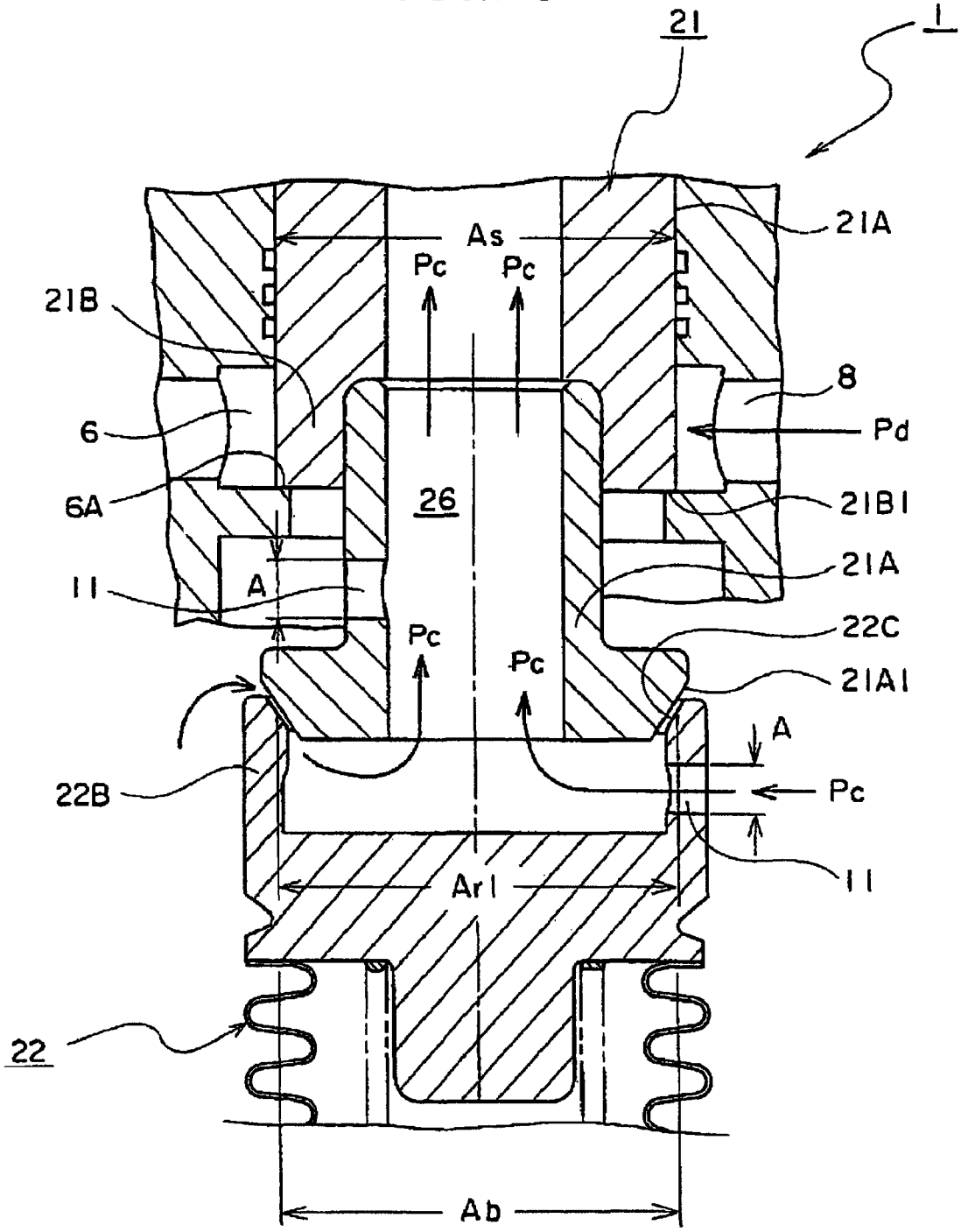
FIG. 5 shows a cross-sectional view of a displacement control valve as a third embodiment of the present invention.
Figure 6:
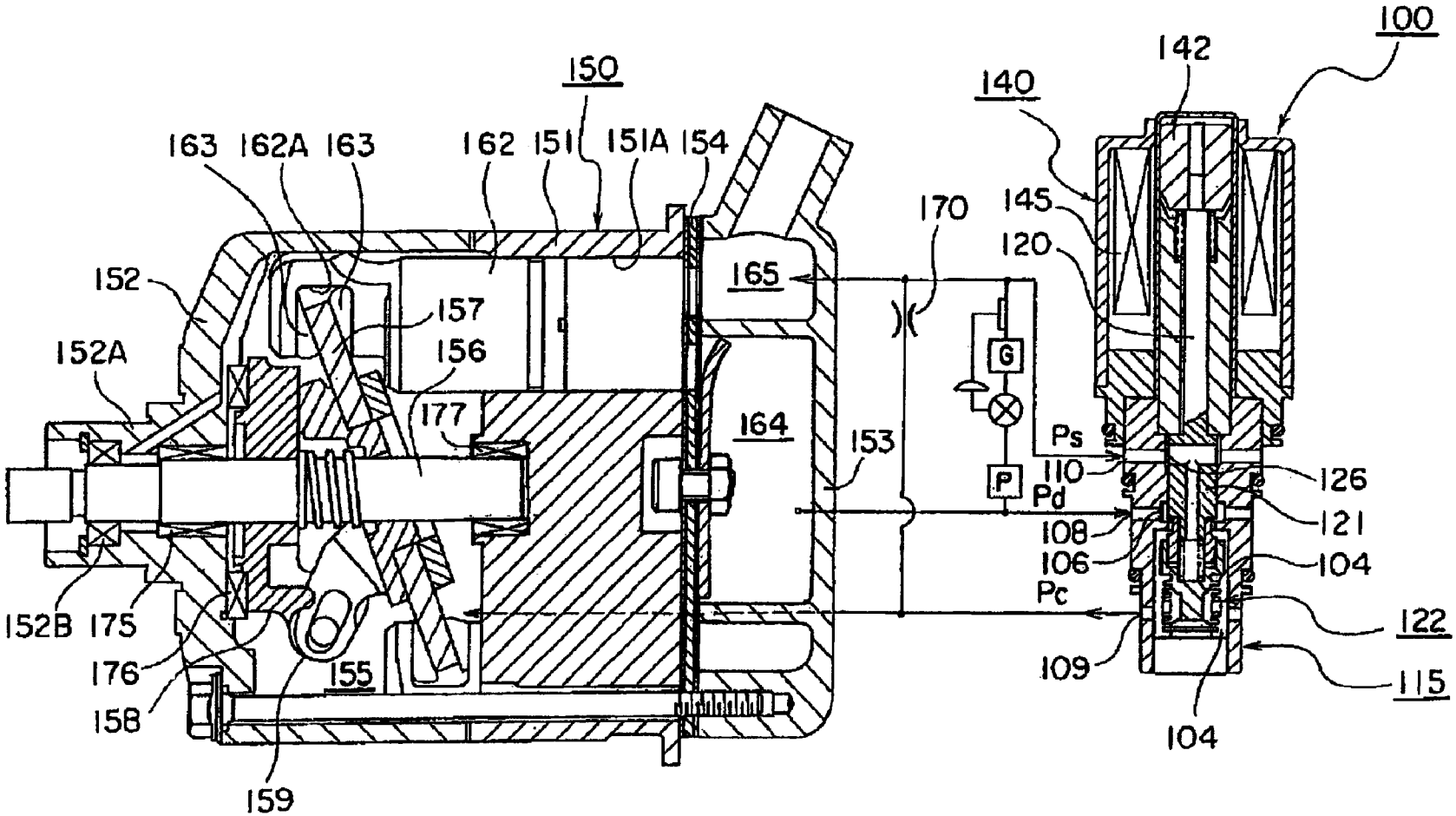
FIG. 6 shows a cross-sectional view of a control valve for variable displacement compressor related to the present invention.

FIG. 5 is a partial cross-sectional view of the displacement control valve of a second embodiment. In the displacement control valve 1 of the FIG. 5, a constitution different from the displacement control valve 1 of FIG. 1 is that the auxiliary communication passages 11 are provided on both of the first valve member 21A and the valve seat portion 22B. It is better that a diameter A of the auxiliary communication passage 11 is a half of the case of FIG. 1 of respective flow amount cross section area. Other constructions are the same as FIG. 1. Note that, the effective pressure receiving area Ab of the pressure sensing device 22, the pressure receiving area Ar1 of the first valve member 21A and sealing pressure receiving area As of the second valve member 21B are about identical. Note that, FIG. 5 shows a status that the first valve seat portion 22B and the first valve portion 21A are slightly open by acting the suction pressure Ps (refer to FIG. 1) to the valve seat portion 22B. From the valve opened space, the refrigerant gas is also discharged to the third communication passage 10 which is similar with the auxiliary communication passage 11. Functions and effects of the respective valve member by the respective pressure receiving area are as stated above. Note that, in FIG. 3 and FIG. 4, unspecified other numeral references are almost identical with that of FIG. 1.

Below, with respect to the other embodiments according to the present invention, their constitution, function and effects will be specified.

A displacement control valve of a first invention according to the present invention, a diameter of an auxiliary communication passage is set in a range of from 0.8 mm to 2 mm.

By the displacement control valve according to the first invention, when the diameter of the auxiliary communication passage is set in a range 0.8 mm to 2 mm, it is available to control the pressure status of a control chamber by rapidly evaporating the refrigerant liquid in the control chamber and is available to maintain the most appropriate pressure control condition while an air conditioner is in operation.

INDUSTRIAL APPLICABILITY

As mentioned above, it is useful as a displacement control valve to achieve displacement control at its proper setting certainly and rapidly by quickly discharging the refrigerant liquid that remains in a control chamber immediately after stating a compressor. Also, the displacement control valve can be minimized as well as its structure simplified, and further, it is useful as displacement control valve which is available to reduce a manufacturing cost.

The invention claimed is:

1. A displacement control valve modulating a fluid flow or fluid pressure within control chamber by means of controlling the opening degree of valve portion, said displacement control valve comprising;

a valve main body having a first valve chamber, a second valve chamber and a third valve chamber, said first valve chamber communicating with a first communication passage for permitting fluid at control pressure to flow therethrough, said second valve chamber having a second valve seat face for a valve hole communicating with said first valve chamber, said second valve chamber communicating with a second communication passage for permitting fluid at discharge pressure to flow therethrough, said third valve chamber having a third valve seat face, said third valve chamber communicating with a third communication chamber for permitting fluid at suction pressure to flow therethrough;

a valve body being disposed within said valve main body and having a first valve member, a second valve member and a third valve member, said second valve member having an intermediate communication passage therein communicating with said first valve chamber and said third communication passage, said second valve member opening or closing a valve hole with respect to said second valve seat face, thereby communicating with said first valve chamber and said second valve chamber, said third valve member performing a valve opening/closing action with respect to said third valve seat face in an reverse synchronous manner against said second valve member, thereby opening or closing the communication with said intermediate communication passage and said third communication passage, said first valve member being disposed in said first valve chamber and performing a valve opening/closing action in the same direction in a synchronous manner to said second valve member;

a pressure sensing member being disposed within said first valve chamber, said pressure sensing member having a valve seat portion, said valve seat portion being disposed at a free end of said pressure sensing member, said free end performing an expanding or contracting action in accordance with suction pressure, said valve seat portion performing a valve opening/closing action with respect to said first valve member, thereby opening or closing the communication with said first valve chamber and said intermediate communication passage; and a solenoid member being installed in said valve main body, said solenoid member driving said valve body for opening or closing the respective valves of said valve body in accordance with an electric current supplied thereto;

wherein an auxiliary communication passage is disposed in said valve body and/or said valve seat portion within said first valve chamber, said auxiliary communication passage providing a communication between said first valve chamber and said intermediate communication passage.

2. A displacement control valve according to claim 1, wherein the diameter of said auxiliary communication passage is set in a range of from 0.8 mm to 2 mm.

* * * * *

UNITED STATES PATENT AND TRADEMARK OFFICE

CERTIFICATE OF CORRECTION

PATENT NO. : 8,079,827 B2
APPLICATION NO. : 12/282879
DATED : December 20, 2011
INVENTOR(S) : Iwa et al.

It is certified that error appears in the above-identified patent and that said Letters Patent is hereby corrected as shown below:

ON THE TITLE PAGE:

Item (73), please delete:

"Assignee: Eagle Industry Co., Ltd., Tokyo (JP)"

And insert:

Item --(73) Assignees: Eagle Industry Co., Tokyo (JP)
Delphi Technologies, Inc., Michigan (US)--

Signed and Sealed this
Twenty-eighth Day of August, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,079,827 B2
APPLICATION NO. : 12/282879
DATED : December 20, 2011
INVENTOR(S) : Toshiaki Iwa et al.

It is certified that error appears in the above-identified patent and that said Letters Patent is hereby corrected as shown below:

This certificate supersedes the Certificate of Correction issued August 28, 2012. The certificate is vacated since petition to add assignee was dismissed. The Certificate of Correction should not have been issued for this patent.

Signed and Sealed this
Thirtieth Day of October, 2012

David J. Kappos

David J. Kappos
*Director of the United States Patent and Trademark Office*